US005479182A

United States Patent [19]

Sydor

[11] Patent Number: 5,479,182

[45] Date of Patent: Dec. 26, 1995

[54] SHORT CONICAL ANTENNA

[75] Inventor: John T. Sydor, Ottawa, Canada

[73] Assignee: Her Majesty the Queen in right of Canada, as represented by the Minister of Communications, Ottawa, Canada

[21] Appl. No.: 24,463

[22] Filed: Mar. 1, 1993

[51] Int. Cl.[6] ..... H01Q 1/36

[52] U.S. Cl. ..... 343/895

[58] Field of Search ..... 343/895, 765; H01Q 1/36

[56] References Cited

U.S. PATENT DOCUMENTS

| | | | |
|---|---|---|---|
| 2,919,442 | 12/1959 | Nussbaum | 343/895 |
| 3,283,332 | 11/1966 | Nussbaum | 343/895 |
| 3,449,752 | 6/1969 | Spitz et al. | 343/895 |
| 3,550,136 | 12/1970 | Walter et al. | 343/742 |
| 3,568,205 | 3/1971 | Buxton et al. | 343/749 |
| 3,641,580 | 2/1972 | Monser | 343/895 |
| 4,097,867 | 6/1978 | Eroncig | 343/715 |
| 4,114,164 | 9/1978 | Greiser | 343/895 |
| 4,161,737 | 7/1979 | Albright | 343/749 |
| 4,169,267 | 9/1979 | Wong et al. | 343/895 |
| 4,494,117 | 1/1985 | Coleman | 343/895 |
| 4,525,720 | 6/1985 | Corzine et al. | 343/895 |
| 4,675,690 | 6/1987 | Hoffman | 343/895 |
| 4,697,192 | 9/1987 | Hofer et al. | 343/895 |
| 4,742,359 | 5/1988 | Ishino et al. | 343/895 |
| 4,800,395 | 1/1989 | Balzano et al. | 343/985 |
| 4,945,363 | 7/1990 | Hoffman | 343/895 |

FOREIGN PATENT DOCUMENTS 839970 4/1970 Canada .

OTHER PUBLICATIONS

*A 50 ohm Input Impediance for Helical Beam Antennas,* John D. Kraus, IEEE Transactions on Antennas and Propagation, vol. AP–25, No. 6, Nov. 1977.

*A Helical Launcher for the Helical Antenna,* B. A. Munk and L. Peters, Jr., IEEE Transactions on Antennas and Propagation, May 1968.

*Extremely Low–Profile Helix Radiating a Circularly Polarized Wave,* Hisamatsu Nakano et al., IEEE Transactions on Antennas and Propagation, vol. 39, No. 6, Jun. 1991.

*A New Helical Antenna Design for Better On–and Off–Boresight Axial Ration Performance,* Cheng Donn, IEEE Transactions on Antennas and Propagation, vol. AP–28, No. 2, Mar. 1980.

*An Experimental Investigation of Cavity–Mounted Helical Antennas,* A. Bystrom, Jr. et al, IRE Transactions on Antennas and Propagation, Jan.

*Backfire Radiation from a Monofilar Helix with a Small Ground Plane,* Hisamatsu Nakano et al IEEE Transactions on Antenna and Propagation, vol. 36, No. 10, Oct. 1988.

(List continued on next page.)

*Primary Examiner*—Michael C. Wimer
*Attorney, Agent, or Firm*—Thomas Adams

[57] ABSTRACT

An antenna suitable for mounting upon vehicles, vessels or aircraft for communication via satellites comprises a conductive ground plane and a radiator element in the form of a conductor helically wound to define a frusto-conical shape with the ground plane as its base. The conductor may be formed upon a dielectric substrate in the shape of a truncated cone. The dimensions of the antenna element are selected so that the pitch angle of the radiator element varies between a minimum of about 6 degrees and a maximum of about 8 degrees. The required pitch angle may be achieved when the cone angle of the frusto-conical shape is between 5 degrees and 20 degrees and the mean diameter of the frusto-conical shape is between 0.3 and 0.47 of a mean operational wavelength predetermined for the antenna. The length of the radiator element is selected to be the minimum needed to sustain a wave. Optimum performance with compact size is attained when the ground plane is about two thirds of the operational wavelength, the cone angle is about 10 degrees and the maximum diameter of the frusto-conical shape is equal to about one half of the wavelength.

11 Claims, 3 Drawing Sheets

OTHER PUBLICATIONS

*Domestic Mobile Satellite Systems in North America,* Muya Wachira, International Mobile Satellite Conference, Ottawa, 1990.

*Radiation Characteristics of Short Helical Antenna and its Mutual Coupling,* H. Nakano et al, Electronics Letters, Mar. 1, 1984, vol. 20 No. 5.

Impedance Matching of Helical Antennas, Robert J. Stegen, IEEE Transactions of Antennas and Propagation, Jan. 1956.

SHORT CONICAL ANTENNA

FIELD OF THE INVENTION

The invention relates to antennas and especially to antennas for mounting upon vehicles, vessels or aircraft for communication via satellites.

BACKGROUND

Mobile satellite systems will allow mobile earth stations, namely vehicles, aircraft or boats, to communicate via satellites. Such a system, known as MSAT, is being developed for North America with the intention of providing services such as mobile telephone, mobile radio and mobile data transmission. Antennas which have been proposed for use with MSAT mobile earth stations are typically large and/or expensive. One such antenna, for example, comprises a rod about one meter long and several centimeters in diameter, while another comprises a disc of about 25 centimeters in diameter and about 5 centimeters thick, which would be mounted several centimeters above the roof of the vehicle. When an antenna is mounted upon a vehicle, especially an automobile, or an aircraft, it is subject to dynamic forces caused by wind drag, inertia and so on, which can cause performance degradation. Moreover, an antenna of large size and ungainly appearance would detract from the aesthetic appearance of the automobile and could dissuade potential users from subscribing to the system.

It is desirable, therefore, for the antenna for the mobile earth station to be relatively small and unobtrusive, especially if it is to be mounted upon an automobile.

It has also been proposed to use antennas which use electronically-phased steering, but they are complicated and expensive to build. Also, these antennas tend to be relatively large so as to compensate for losses in the phasing circuits.

The present inventor prefers to use a mechanically steered antenna with a directional active antenna element. Although they can be relatively small, known mechanically steered antennas require precision machined parts, which would tend to make them expensive and unreliable. They also would require relatively large radiator elements to compensate for losses in their rotary couplings. For a mechanically steered antenna to be viable, improvement is required in the coupling efficiency and the gain of the radiator element. The present inventor's copending application Ser. No. 08/024,461, filed concurrently herewith, now U.S. Pat. No. 5,432,524, the entire contents of which are incorporated herein by reference, addresses the problem of rotary couplings for such mechanically steered antennas.

So far as the active antenna element is concerned, a generally helical shape is beneficial because it is highly directional, broadband, has high gain and has a high axial ratio. Helical antennas are, of course, well known. In an article entitled "A New Helical Antenna Design for Better On-and Off-Boresight Axial Ratio Performance", IEEE Transactions on Antennas and Propagation, Vol. AP-28, No. 2, March 1980, Cheng Donn discloses several helical antennas. One has a partially tapered end, with sixteen normal turns and two turns on the taper, while his preferred design has sixteen normal turns and between four and eight turns on the taper. Such an antenna element would, however, be unsuitable for a compact mechanically steered antenna.

Short, cylindrical helical antennas are discussed by H. Nakano et al in several articles, namely "Radiation Characteristics of Short Helical Antenna and its Mutual Coupling", Electronics Letters, Mar. 1, 1984, Vol. 20, No. 5; "Backfire Radiation from a Monofilar Helix with a Small Ground Plane", IEEE Transactions on Antennas and Propagation, Vol. 36, No. 10, October 1988; "Extremely Low-Profile Helix Radiating a Circularly Polarized Wave", IEEE Transactions on Antennas and Propagation", Vol. 39, No. 6, June 1991. From these articles, it is apparent that a highly shortened helix of 1.5 to 2 turns with a pitch angle of the order of 4–8 degrees can be an efficient radiator. The performance figures disclosed by Nakano et al, however, are for infinite ground planes. When mounted upon small ground planes, as required in practice for mobile earth stations, highly shortened helical antennas are difficult to impedance-match, have a high return loss, and do not have sufficient gain to meet current (MSAT) mobile satellite system requirements.

Conical antennas have been disclosed in U.S. Pat. No. 3,283,332, (Nussbaum) issued November 1966; U.S. Pat. No. 4,675,690 (Hoffman) issued Jun. 23, 1987; and Canadian patent number 839,970 (R. Gouillou et al), issued Apr. 21, 1970. As disclosed especially by Hoffman and by Gouillou et al, a lightweight antenna may be made economically by forming a conductor onto a substrate by means of a photoresist-type etching process and rolling the substrate to form a cone or, as in one of Gouillou et al's examples, a trunco-conical shape. Each of these conical antennas would be unsuitable for mobile earth terminals due to one or more of the following: poor directivity; large size; poor axial ratio; insufficient gain; poor bandwidth; frequency sensitive performance.

Despite this extensive state-of-the-art in antennas, the technical requirements for MSAT are so stringent that the MSAT specifications envisage the use of two different antennas for the mobile earth stations. One would be used by mobile earth stations operating in the more northerly latitudes of the satellite's coverage area and the other in the more southerly latitudes. This duplication is undesirable. It would, of course, be preferable for a single antenna to be used for all latitudes.

SUMMARY OF THE INVENTION

The present invention seeks to provide an improved antenna which is suitable for mobile earth terminals of mobile satellite systems.

According to the present invention, an antenna comprises an active antenna element comprising a ground plane and a conductor wound in the shape of a tapered helix, the helix having a maximum diameter adjacent the ground plane and a minimum diameter at an end remote therefrom. Preferably the maximum diameter is between one third of a wavelength and one half of a wavelength of a prescribed operational frequency for the antenna. The ground plane has a diameter of between one third and one wavelength of the operating frequency.

Preferably, the maximum diameter is equal to just less than one half of the wavelength and the ground plane diameter is equal to about two thirds of the wavelength.

The conductor may be wound upon a substrate in the form of a frustum of a cone and mounted upon the ground plane. The conductor may be formed upon the substrate using photolithographic techniques. The planes defining the frustum need not be parallel.

Various objects, features, aspects and advantages of the present invention will become more apparent from the following detailed description, in conjunction with the accompanying drawings, of preferred embodiments of the invention.

DESCRIPTION OF PREFERRED EMBODIMENTS

Figure 1:
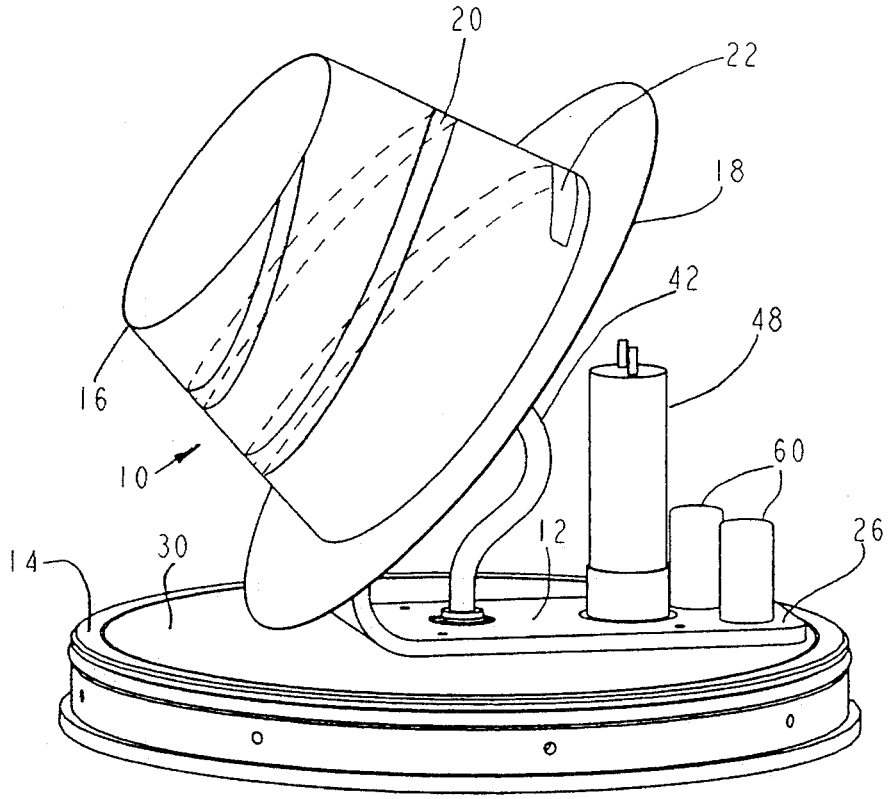
FIG. 1 is a pictorial view of a first antenna embodying the invention.
Figure 2:
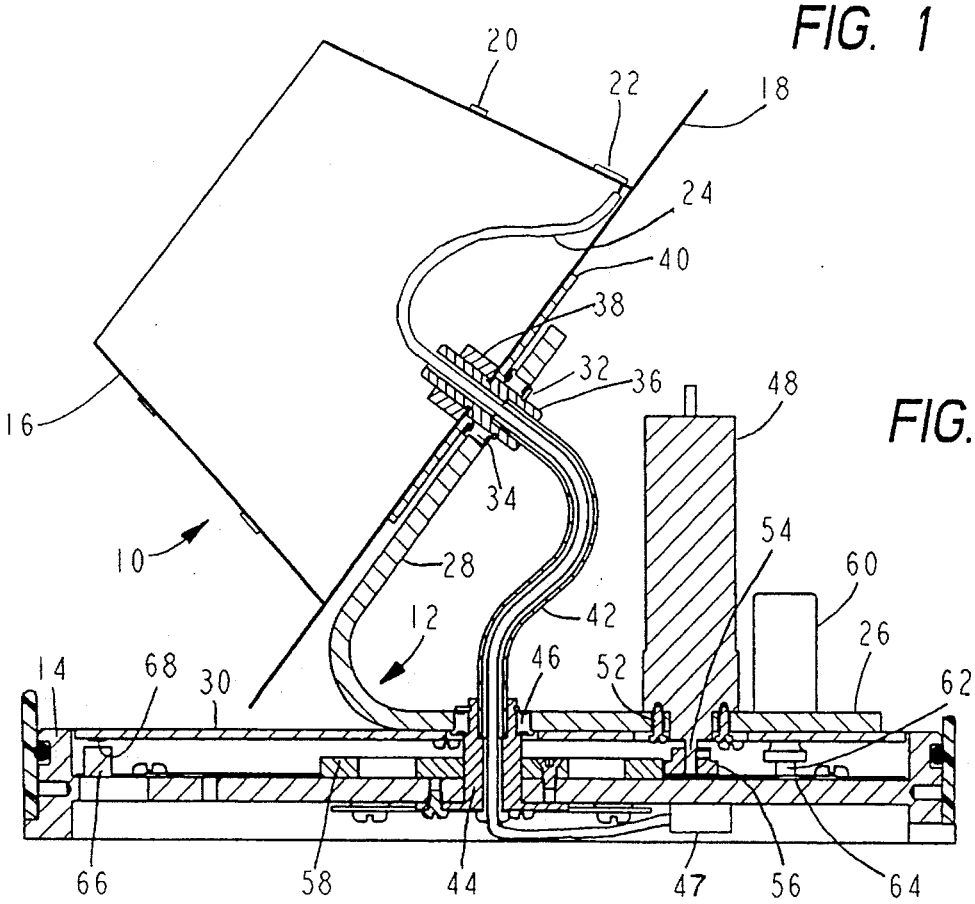
FIG. 2 is a longitudinal cross section of the antenna of FIG. 1.

Referring first to FIGS. 1 and 2, a mechanically steerable antenna for mounting upon a vehicle for communication via satellite of mobile radio communications, telephony, data, direct audio broadcasts, or other such signals, is shown in FIG. 1 with its radome removed and in FIG. 2 with its radome cut away. The antenna comprises an active antenna element 10 rotatably mounted upon a support member 12 which is itself rotatably mounted upon a base member 14. The antenna element 10 comprises a frustum or truncated cone 16 of flexible printed circuit board material with its base bonded to a circular ground plane 18 made of suitable conductive metal such as copper, aluminium, magnesium and so on. The ground plane 18 may conveniently be formed of printed circuit board material also.

Figure 7:
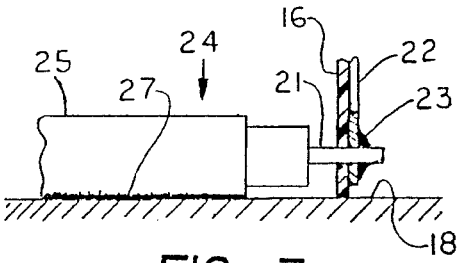
FIG. 7 is a cross-sectional view of the connection between the matching transformer and a feed cable.

A short, helical copper conductor 20 printed upon the conical printed circuit board substrate 16 comprises the radiator or receptor element of the antenna element 10. The helical conductor 20 terminates at its maximum diameter end in an impedance matching transformer 22. The matching transformer 22 comprises a wedge shaped continuation of the end portion of the conductor 20. The lower edge 140 of the matching transformer 22 is positioned adjacent the ground plane 18. The combined length of the matching transformer 22 and the helical conductor 20 is about one and three quarters turns. As shown in FIG. 7, the core 21 of a coaxial feed cable 24 extends through aligned holes in the substrate 16 and matching transformer 22 and is soldered to the latter as indicated at 23. The outer shield 25 of the cable 24 is soldered to the ground plane 18 as indicated at 27. The other end of the cable 24 is connected to circuitry in base member 14, as will be described later.

Referring again to FIG. 2, the support member 12 comprises two arms 26 and 28. Arm 26 is mounted upon a platform member 30 which is rotatably mounted upon the base member 14. A bearing 32 is located in a hole 34 in the upper portion of arm 28. A tubular spindle 36 has one end fitted into the bearing 32 and its other end is screwthreaded and protrudes upwards from the arm 28. The antenna element 10 is mounted upon the tubular spindle 36, which extends through a hole in the centre of the ground plane 18, and is secured by a fastening nut 38. The ground plane 18 is reinforced in the vicinity of the spindle 36 by means of a circular boss 40 formed integrally with the ground plane. The spindle 36 and the ground plane 18 could, of course, be formed integrally, for example by die casting.

A flexible coupling in the form of a cylindrical spring 42 connects the antenna element 10 to base member 14. The cylindrical spring 42 has one end fitted tightly into the lower end of spindle 36. Its other end is fitted tightly into the upper end of a spigot 44 which extends through the platform member 30 and is fixed, non-rotatably, to the base member 14. The platform member 30, and arm 26 of support member 12, are rotatably mounted upon the base member 14 by means of a bearing 46. The inner ring of bearing 46 fits around the upwardly protruding end of spigot 44 and is supported by a shoulder. The outer ring of bearing 46 is secured in a hole in arm 26.

The coaxial feed cable 24 extends through cylindrical spring 42, entering it via the spindle 36 and leaving it via the spigot 44, to connect the matching transformer 22 to a diplexer 47 mounted beneath the base member 14. The diplexer 47 will be connected to other circuitry (not shown) of the transmitter or receiver which may or may not be mounted upon the base member 14. This additional circuitry will be of conventional design and so will not be described further.

A drive motor 48 mounted upon the support member 12 serves to rotate the support member 12 relative to base member 14. Drive motor 48 is attached to the support member 12 by means of screws 52 and its drive shaft 54 extends through the support member 12 and platform member 30. A pinion 56 carried by drive shaft 54 engages a ring gear 58 fixed to the base member 14. As the pinion 56 rotates, the drive motor 24 and the support member 12 rotate relative to base member 14. Two brush assemblies 60 are mounted upon the support member 12 so that their carbon brushes 62 engage slip rings 64 on the upper surface of base member 14 to pick up motor drive current (DC) as the support member 12 rotates.

The position of the support member 12, and hence the antenna element 10, relative to the base member 14, at any instant, is measured by an optical encoder 66 which is mounted upon the base member 14. The optical encoder 66 reads patterns 68 on the platform member 30 and supplies corresponding position signals to the control circuitry (not shown).

As the support member 12 rotates relative to the base member 14 about the vertical rotation axis of bearing 46, the flexible coupling 42 will prevent rotation of the antenna element 10 relative to the base member 14. As a result, the antenna element 10 will rotate oppositely relative to the support member 12 about the rotation axis of bearing 32, which is also the boresight of the antenna element 10. Hence, as the antenna element 10 rotates about the boresight axis, it will sweep an arc around the rotation axis of bearing 46. At the same time, the cylindrical spring 42 will flex relative to its own cylindrical axis—although it does not, itself, rotate about that axis. Likewise, the coaxial cable 24 will flex as the antenna element 10 rotates. It should be appreciated that the flexible coupling 42 and coaxial cable 24 may experience some twisting as torsional forces are built up, but these will be released as the antenna element rotates so that neither the flexible coupling nor the coaxial cable is permanently twisted. The coaxial cable 24 must be able to tolerate repeated flexing and some twisting. A cable employing a laminated Teflon (Trade Mark) dielectric and conductors of wrapped silver foil and highly stranded silver coated copper has been found to be satisfactory. Suitable cables are marketed by Goretex Cables Inc. as Gore Type 4M and Gore Type 4T.

The radiation pattern of antenna element 10 is symmetrical about its boresight, so rotation of the antenna element 10 about the boresight axis does not have any significant effect upon the gain of the antenna. In use, the base member 14 will usually be mounted generally horizontally and the platform member 30 will be rotated about the vertical axis. Support arm 28 is inclined relative to arm 26 so that the angle between the rotation axis or boresight of the antenna element 10 and the platform member 30 is substantially equal to the mean elevation angle of the satellite with which the antenna is to communicate signals. As an example, where the antenna is to be used in North America with MSAT satellites, the mean elevation angle would be approximately 40°.

Figure 3:
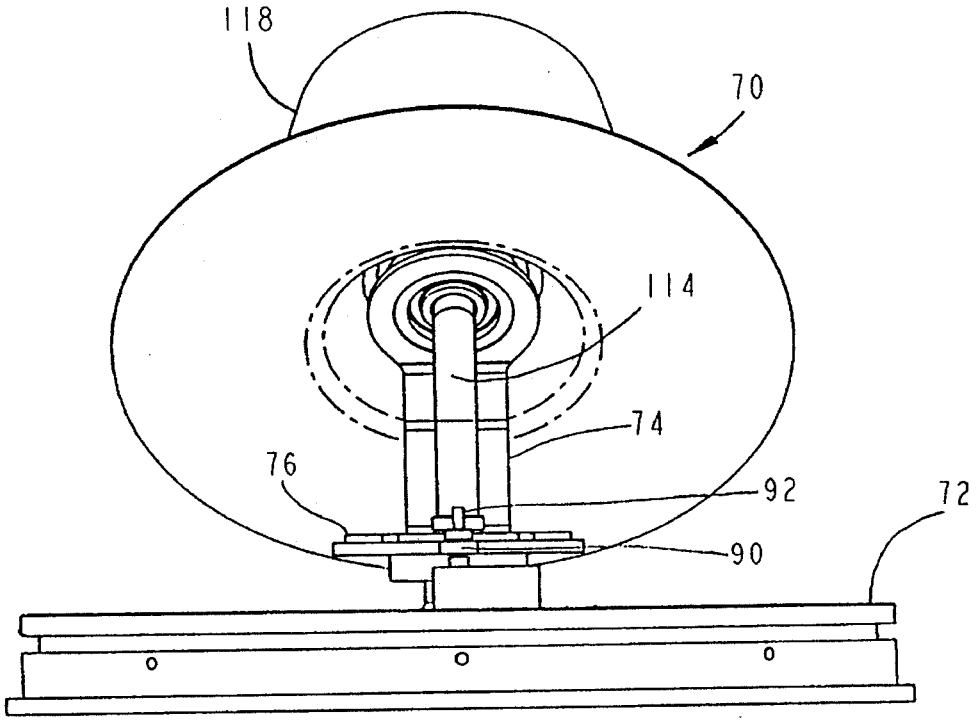
FIG. 3 is an elevation of a second embodiment of the invention.
Figure 4:
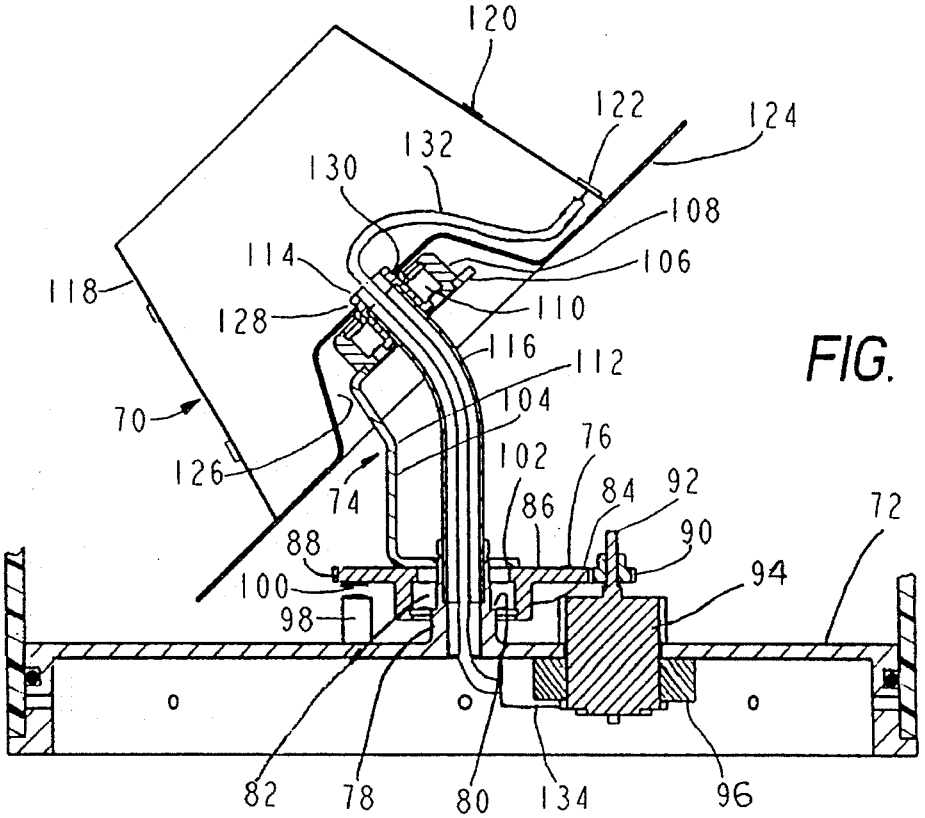
FIG. 4 is a longitudinal cross section of the antenna of FIG. 3.

A second, even more compact embodiment of the invention is illustrated in FIGS. 3 and 4. The antenna shown in FIGS. 3 and 4 is generally similar to that described above in that it comprises an active antenna element 70 mounted upon a base member 72 by means of a cranked support arm 74 carried by a rotatable platform member 76. A spigot 78 projects upwards from the centre of the base member 72 and has an external shoulder 80. A bearing 82 mounted upon the spigot 78, resting upon the shoulder 80, supports the platform member 76. The bearing 82 is accommodated in a recess in a cylindrical boss 84 of platform member 76. The boss 84 carries a circular flange 86 which has a peripheral ring gear 88. The ring gear 88 engages a drive pinion 90 carried by the drive shaft 92 of a drive motor 94 mounted upon the base member 72 by a bracket 96. An optical encoder 98 reads patterns 100 on the underside of platform 76 to provide signals representing the position of the platform member 76, and hence the antenna element 10, at any instant. These signals are supplied to a control unit (not shown) for the drive motor 94.

The support arm 74 has a first portion 102 attached to the platform 76 by screws or any other suitable means (not shown), an upstanding portion 104, and an upper portion 106. A cylindrical boss 108 attached to the upper portion 106 houses a bearing 110. The upstanding portion 104 is cranked at 112 so that the upper portion 106 subtends an angle of approximately 50 degrees to the plane of the platform member 76. As a result, the rotation axis of the bearing 110, and hence the boresight of antenna element 70, is at an angle of approximately 40 degrees to the plane of the platform member 30 which, in operation, will be horizontal. Hence, the boresight is set to the elevation angle of the satellite, as previously described.

A tubular thimble member 114 extends through the bearing 110 and is a close fit to its inner ring. One end of a tubular flexible spring member 116 extends into, and is a tight fit in, the lowermost end of the thimble member 114. The other end of the flexible spring member 116 is a tight fit in the mouth of spigot 78. Hence, the flexible spring member 116 couples the thimble member 114, and with it the antenna element 70, non-rotatably to the base member 14.

The antenna element 70 is similar to antenna element 10 shown in FIG. 1 in that it comprises a truncated cone 118 of flexible printed circuit board material and a printed copper conductor 120 terminating in a printed copper matching transformer 122. Its ground plane 124, however, differs in that it has a central recessed portion 126. The end portion of thimble member 114 extends through a hole 128 in the middle of recessed portion 126. A circlip 130 on the protruding end of thimble member 114 secures the antenna element 10 to the thimble member 114.

As before, a feed line in the form of a coaxial cable 132 has its inner conductor connected to the matching impedance and its outer shield soldered to the adjacent surface of the ground plane 124. The cable 132 extends through the thimble 114, flexible spring member 116 and spigot 78 to emerge within the base member 72 where it is connected to a diplexer 134. The diplexer 134 couples the signals from antenna element 10 to the receiver circuitry (not shown).

When the antenna is in use, the drive motor 94 rotates the platform member 76 about the vertical rotation axis of bearing 82. As in the embodiment of FIG. 1, flexible spring member 116 will prevent rotation of the antenna element 10 relative to the base member 72, causing it to rotate about its boresight axis relative to platform member 76. Because the recessed portion 126 extends around and shrouds the upper portion 106 of support member 74 and the bearing 110 and its housing 108, the flexible spring member 116 and cable 132 can be straighter, which reduces wear and tear upon them due to flexing, further improving reliability and durability. Moreover, recessing the ground plane to accommodate the bearing and its housing further reduces the size of the antenna, without significantly affecting its electromagnetic performance. The arrangement also gives better stability when the antenna is subjected to inertial forces.

The mechanical steering arrangements shown in FIGS. 1–4 may be used with many kinds of antenna element, for example circular, square, pentagonal, microstrip patches or dielectrically loaded Yagi antenna elements. The particular active antenna element shown in FIGS. 1–4 is preferred because it is compact, yet provides a symmetrical radiation pattern with relatively high gain. With careful selection of its dimensions, such an antenna element may be so efficient that the performance requirements for MSAT can be met with a single antenna, rather than different antennas for different latitudes as envisaged by the MSAT specifications.

Figure 5:
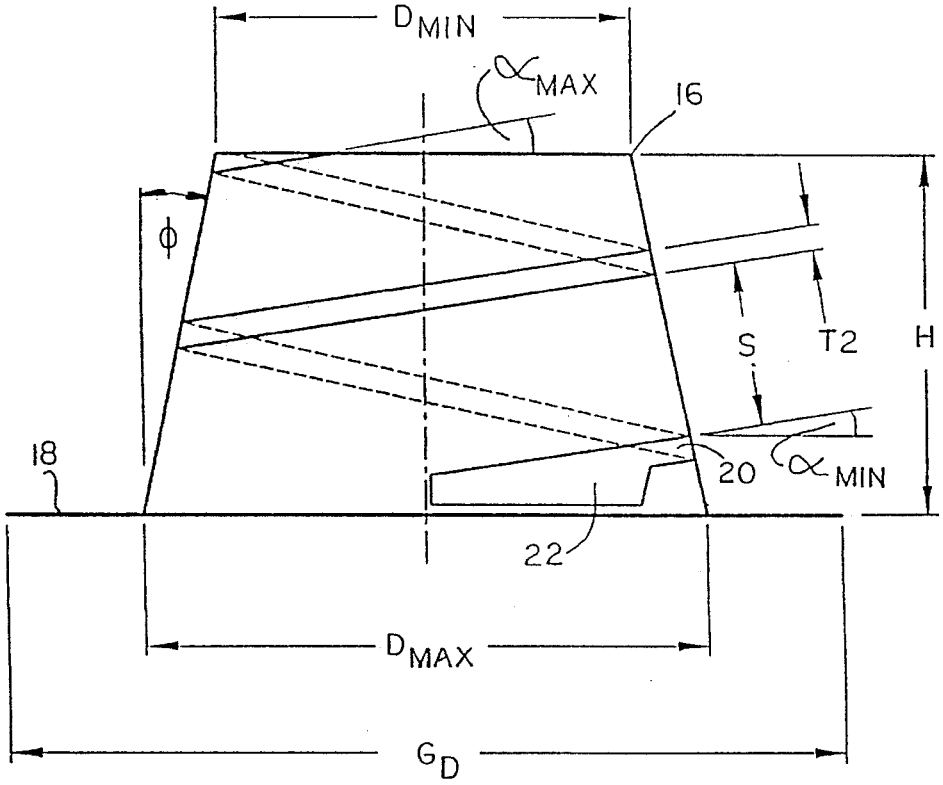
FIG. 5 is a view of the radiator element and ground plane of the antenna elements used in the embodiments of FIGS. 1 and 4.

Referring now to FIG. 5, the critical dimensions of the antenna element 10/70 are identified as follows:

| | |
|---|---|
| Maximum diameter of substrate | $D_{MAX}$ |
| Minimum diameter of substrate | $D_{MIN}$ |
| Height of substrate | H |
| Diameter of ground plane | $G_D$ |
| Width of helical conductor | T2 |
| Spacing between turns of helix | S |
| Cone angle | $\phi$ |
| Pitch angle | $\alpha_{MIN} \leqq \alpha \leqq \alpha_{MAX}$ |

Over small ground planes, highly shortened helical antennas are difficult to match and have high return loss. Experiments have shown that matching performance and return loss are significantly improved if the radiator element is wound upon a conical substrate that allows the pitch angle $\alpha$ of the helical conductor 20/120 to vary between $\alpha_{MIN}$ equal to 6 degrees and $\alpha_{MAX}$ equal to 8 degrees.

It is envisaged, that the minimum pitch angle might range between 4 degrees and 8 degrees, with a corresponding range of 6 degrees to 10 degrees for the maximum pitch angle.

It is also envisaged that the cone angle $\phi$ could be between 5 and 20 degrees. For cone angles less than 5 degrees or greater than 20 degrees, it is expected that performance will degrade to unacceptable levels due to increased return loss and decreased bandwidth.

Experiments have shown that an antenna element 10/70 for use with a mobile earth terminal of MSAT, operating over a frequency range of 1530 MHz. to 1660 MHz., can meet MSAT performance requirements for mobile earth terminal G/T and EIRP over the entire range of latitudes when the dimensions (FIG. 5) are selected such that:

$D_{MIN}$ is about equal to $\lambda/3$; where $\lambda$ is the mean operational wavelength;

$D_{MAX}$ is just less than $\lambda/2$, specifically 0.46 $\lambda$

Ground plane diameter $G_D$ is about $2\lambda/3$;

Winding spacing S is such that pitch angle $\alpha$, defined as Arctan ($S/\pi D$), varies uniformly over the length of the conductor between a minimum $\alpha_{MIN}$ of 6 degrees adjacent the base and a maximum $\alpha_{MAX}$ of 8 degrees adjacent the vertex;

Cone angle $\phi$ is 10 degrees;

The conductor 20/120 and 22/122 comprises one and three quarter turns of the helix.

The resulting antenna can be housed in a bullet shaped radome about 14 cms. diameter and about 14 cms. high and is so light that it can be mounted onto the roof of an automobile using magnets or to the rear window using adhesives.

Experiments have shown that such a short conical helical antenna placed over a small ground plane can have a gain of 9–9.5 dB over the frequency band of 1530 MHz to 1660 MHz. The return loss was in excess of −15 dB over a bandwidth of 7.5 per cent of the centre operating frequency of 1595 MHz and the 3 dB beamwidth in the E and H planes was in the order of 60 degrees. By contrast a regular highly shortened antenna on the same ground plane had comparable return loss over a bandwidth of only 4 per cent. With both antennas optimally matched and placed over a small ground plane, the gain of the conical antenna was at least 0.5 dB greater than that of the regular helical antenna.

In particular, three antennas were constructed and tested. Two short, regular helical antennas, and one conical antenna according to the invention, were each mounted over a 13 cm. diameter ground plate. Each antenna had 1.75 turns. One of the regular helical antennas had a 4 degree pitch angle and the other had a 6 degree pitch angle. The conical antenna element was formed around a frustum of a cone having a slope angle of 10 degrees. As a result, the pitch angle of this conical antenna varied uniformly from 6 to 8 degrees. The helical antenna with a 4 degree pitch angle had a nominal return loss of −7 dB over the design bandwidth. The helical antenna with a 6 degree pitch angle had a nominal return loss of −9 to −12 dB. The conical antenna had a return loss of −15 to −17 dB with a significant portion in excess of −20 dB. These results are considered valid over the operational band of 1530 MHz. to 1660 MHz.

While the conductor 20/120 could be longer than one and three quarter turns, it is desirable to have the minimum number of turns so as to keep the occupied volume of the antenna to a minimum. In any event, any increase in length would increase occupied volume and decrease antenna beamwidth, which would result in compromising of MSAT requirements.

While the specific embodiment of the invention will have these dimensions in order to meet MSAT requirements, the frusto-conical form can be utilized with a range of mean diameters and pitch angles. Experimental evidence shows that antennas with the following dimensions perform satisfactorily:

| Ground Plane Diameter | Pitch Angle in Degrees | Cone Angle in Degrees | Max Dia. of Cone | No. of Turns |
|---|---|---|---|---|
| $2\lambda/3$ | 4–5 | 5–10 | $0.3\lambda$ | 2 |
| $2\lambda/3$ | 6–8 | 9–11 | $0.4\lambda$ | 1.75–2 |
| $2\lambda/3$ | 7–9 | 11–20 | $0.5\lambda$ | 1.75–2.5 |

Ground plane size is critical to the performance of an antenna which must be as small as possible while satisfying stringent electromagnetic performance requirements such as those specified for MSAT. Over small ground planes, especially between one half and two thirds of the operating wavelength, the gain of the antenna is highly dependent upon ground plane size.

Experimental results have shown that reduction of the ground plane diameter $G_D$ from 1.3 to 0.5 of the mean operating wavelength $\lambda$ produces a difference of as much as 2 dB. in the overall gain of the antenna. The reduction was gradual until a diameter of about $0.67\lambda$ was reached, whereupon the reduction became much more pronounced. Thus, a change from $1.3\lambda$ to $0.67\lambda$ produced a reduction of about 1 dB whereas a change from only $0.67\lambda$ to $0.5\lambda$ also produced a reduction of 1 dB.

Since the gain of a satellite communications antenna is critical for the operation of a satellite link, variation in antenna gain of fractions of a decibel could determine whether the antenna is acceptable or not. Typically, satellite link budget margins for MSAT mobile voice service are of the order of 2 to 4 dB, in which case a reduction of 1.0 dB could be significant. For MSAT, where the gain of the antenna is to be 9 dBic, it has been determined that the ground plane diameter $G_D$ should be at least two thirds of the operational wavelength.

A highly shortened, frusto-conical helical antenna element embodying the invention has been found to give better overall gain, better return loss and better bandwidth than a conventional helical antenna of comparable size and the same number of turns. Where the antenna element is to rotate in azimuth while being inclined at a prescribed elevation angle, the conical shape reduces swept diameter and volume as compared with a cylindrical shape of comparable length and so results in a more compact size.

The polarization and power gain of antennas for satellite communications systems are specified in detail, allowing no more than a few decibels of variation. The conical antenna element with a small ground plane as described herein has circular polarization. It provides better power gain for a given occupied volume as compared with microstrip patches or cavity backed spirals or multiple turn helices. It also has superior return loss performance, at least compared with a short helical antenna over the same ground plane, thereby mitigating diplexer and low noise amplifier requirements for the mobile earth station terminal. Its inherent directivity allows it to meet stringent power gain requirements.

Figure 6:
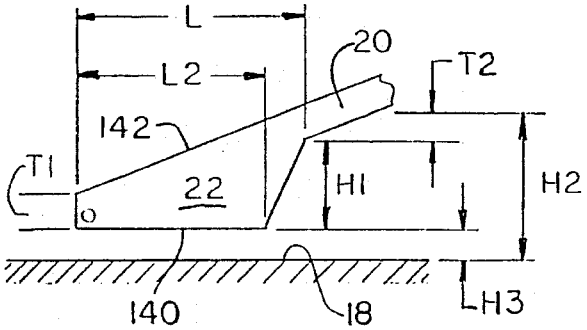
FIG. 6 is a detail view of a printed circuit matching transformer which forms part of the antenna element.

Frusto-conical helical antenna elements embodying the invention have a complex impedance which varies as a function of frequency and as a function of ground plane size. For the specific embodiment described above, the impedance ranged from 55-j60 ohms at 1500 MHz. to 90-j40 ohms at 1650 Mhz. The matching transformer 22/122 is designed to match the characteristic impedance of the antenna element with a coaxial or microstrip feed line 24/28 having an impedance of 50 ohms. Matching transformer 22 is illustrated in more detail in FIGS. 6 and 7. (Matching transformer 122 is identical). The matching transformer 22 is generally wedge shaped with its broader end connected to the conductor 20. One major edge 140 of the matching transformer 22 extends parallel, and in close proximity to, the ground plane 18. The opposite edge 142 diverges at an angle approximately equal to the pitch angle of the adjacent end of the conductor 20, i.e. the matching transformer is tapered. The shape and positioning of the matching transformer provides distributed capacitance to ground, the tapered shape provides varying inductance along its length. As a result, the matching impedance accurately matches the resistive impedance of the cable 24 to the complex impedance of the radiator element 20. The length L, minor width T1, major width T3 and the width H3 of the capacitive gap are critical. A change of more than about 5 per cent in the parameters could have an intolerable effect upon return loss and matching performance. For the antenna element 10 whose dimensions are given above, adequate matching was obtained when the dimensions of the matching transformer shown in FIG. 6, were: width at the narrow T1=6 mm.; width at the broader end, including the conductor, H2=9 mm.; width at broad end minus the conductor, H1=5 mm.; overall length L=42 mm.; length of lower edge 140, L2=39 mm.; conductor width T2=4 mm.; and the spacing between edge 140 and the ground plane, H3=1 mm.

Figure 8:
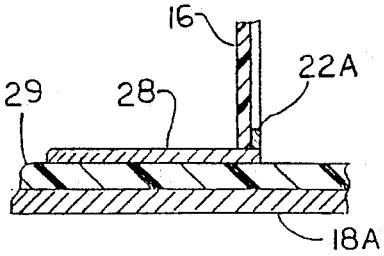
FIG. 8 is a side sectional view of an alternative arrangement in which the printed circuit matching transformer is connected to a microstrip conductor.
Figure 9:
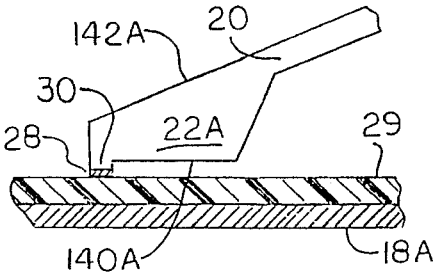
FIG. 9 is a front sectional view of the matching transformer of FIG. 8.

FIGS. 8 and 9 illustrate, as an alternative, connection of the matching transformer 22 to a microstrip transmission line rather than a coaxial cable. The microstrip transmission line comprises a microstrip conductor 28 along the surface of a dielectric plate 29. The ground plane 18A is provided on the opposite surface of the dielectric plate 29. At one end of the edge 140A of matching transformer 22A, a small tab 30 protrudes towards the microstrip conductor 28 and is soldered to it. The presence of the dielectric material 29 between the matching transformer 22 and the ground plane 18A alters the characteristics as compared with the matching transformer 22 of FIG. 6. The changes can be compensated by increasing the overall length of the conductor 20 to ensure that the impedance matching is correct.

Forming the matching impedance integrally with the radiator element using printed circuit techniques allows the dimensions can be reproduced accurately yet economically.

An advantage of a matching transformer formed directly onto the substrate is that it is less susceptible to variation caused by the effects of vibration and inertia.

Various modifications to the described embodiments are possible within the scope of the present invention. The torsional coupling arrangement could be modified quite easily to allow the elevation angle of the boresight to be changed. For example, the support member 12/74 could have separate lower and upper portions coupled together by. means of a pivot. The relative inclination of the upper portion could then be adjusted by a suitable solenoid or motor unit controlled by the receiver to adjust the elevation angle automatically. Adjustment of the elevation angle in this way would permit the gain of the antenna to be optimized and permit the use of antenna elements which have lower intrinsic gain than that described herein.

It will be appreciated that automatic adjustment of the elevation angle could be synchronized to the rotation of support member about the vertical axis so as to compensate automatically for any lack of symmetry of the antenna radiation pattern.

An advantage of embodiments of the invention is that a single antenna embodying the invention may meet both MSAT northern and southern coverage requirements. A further advantage of antennas embodying the invention is that the broad beam allows the G/T and EIRP to be maintained under a variety of conditions. Wind, drag, vibration, acceleration, and changes in road angle and conditions will result in angular changes which can have a significant effect upon the signal level of a narrow beam antenna. Such dynamic changes would have no significant effect upon the performance of an antenna embodying the present invention.

While the specific embodiment of the invention described herein is especially suitable for use on mobile earth stations in the MSAT system, it will be understood that antennas embodying the invention are not limited to such applications but could be used more widely. Indeed, they could be used in any situation which calls for compact size yet relatively high gain, for example for direct audio broadcasts from geostationary satellites or with low earth orbiting communications satellites.

It will be appreciated that the dimensions of the antenna element 10 given in the foregoing detailed description are for operation at about 1600 MHz. They could be scaled to suit other frequencies if the antenna is to be used for other purposes, such as television.

Although, in preferred embodiments of the invention, the conductor is wound with a constant inter-turn spacing, so that its pitch angle varies between a minimum at its end adjacent the base and a maximum at its end adjacent the vertex, it will be appreciated that the inter-turn spacing could be allowed to vary, even to the extent of keeping the pitch angle uniform.

Although embodiments of the invention have been described and illustrated in detail, it is to be clearly understood that the same is by way of illustration and example only and is not to be taken by way of the limitation, the spirit and scope of the present invention being limited only by the appended claims.

What is claimed is:

1. An antenna element comprising a ground plane and a conductor wound in the shape of a tapered helix comprising between about one and three-quarter turns and about two and a half turns, the helix having one end disposed adjacent the ground plane at a maximum diameter of the helix and a distal end remote from the ground plane and at a minimum diameter of the helix and having its pitch angle increasing along its length from a minimum pitch angle at said one end to a maximum pitch angle at said distal end, the minimum pitch angle being in the range from 4 degrees to 8 degrees and the maximum pitch angle being in the range from 5 degrees to 10 degrees, the helix defining a frustum of a cone having the ground plane as its base, said maximum diameter being in the range from about one third of a wavelength to about one half of a wavelength of a prescribed mean operating frequency for the antenna element, said ground plane having a dimension in the range of between about one half of one wavelength and about one wavelength of the prescribed mean operating frequency, the antenna element further comprising a matching transformer comprising an extension of the conductor adjacent the ground plane, the matching transformer comprising a laminar conductor segment having divergent opposite edges, the laminar conductor segment having a broader end portion and a narrower end portion spaced therefrom, the narrower end portion having means for connection of a feed line, one of said opposite edges extending generally parallel to, and in proximity to, the ground plane, the other of said opposite edges diverging at a predetermined angle to said ground plane, the conductor extending from the broader end portion.

2. An antenna element as claimed in claim 1, wherein the maximum diameter of the helix is equal to about one half of said wavelength and the ground plane has a diameter equal to about two thirds of said wavelength.

3. An antenna element as claimed in claim 1, wherein the cone has a cone angle in the range of 5 degrees to 20 degrees.

4. An antenna element as claimed in claim 1, for operation at a frequency of about 1595 Mhz., wherein the conductor has a length of about one and three quarter turns, the helix has a cone angle of about 10 degrees and the spacing between turns of the conductor is such that the conductor has its pitch angle varying between a minimum of about 6 degrees at its end adjacent the ground plane and a maximum of about 8 degrees at its end remote from the ground plane.

5. An antenna element as claimed in claim 1, wherein the conductor is supported by a substrate mounted upon the ground plane, the substrate having the shape of said frustum of a cone.

6. An antenna comprising an antenna element comprising a round plane and a conductor wound in the shape of a tapered helix comprising between about one and three-quarter turns and about two and a half turns, the helix having one end disposed adjacent the ground plane at a maximum diameter of the helix and a distal end remote from the ground plane and at a minimum diameter of the helix and having its pitch angle increasing along its length from a minimum pitch angle at said one end to a maximum pitch angle at said distal end, the minimum pitch angle being in the range from 4 degrees to 8 degrees and the maximum pitch angle being in the range from 5 degrees to 10 degrees, the helix defining a frustum of a cone having the ground plane as its base, said maximum diameter being in the range from about one third of a wavelength to about one half of a wavelength of a prescribed mean operating frequency for the antenna element, said ground plane having a dimension in the range from about one half of one wavelength to about one wavelength of the mean operating frequency, wherein the ground plane has a central cup-shaped portion protruding into the helix, the antenna further comprising support means and bearing means rotatably mounting the ground plane upon said support means, at least part of the bearing means being accommodated within the central cup-shaped portion.

7. An antenna element comprising a ground plane of conducting material and a radiator element in the form of a helical conductor wound about an axis extending substantially perpendicular to the ground plane, one end of the conductor adjacent the ground plane terminating in a matching transformer, the matching transformer comprising a tapered laminar conductor extending as a continuation of the helical conductor and in a direction transverse to the ground plane, the laminar conductor having divergent opposite edges, a broader end portion connected to said one end of the conductor and a narrower end portion spaced therefrom for connection of a feed line, one of said opposite edges extending generally parallel to, and in proximity to, the ground plane, the other of said opposite edges diverging at a predetermined angle to said ground plane.

8. An antenna element as claimed in claim 7, wherein the laminar conductor is inclined at an acute angle to the ground plane.

9. An antenna element as claimed in claim 7, wherein the laminar conductor is substantially perpendicular to the ground plane.

10. An antenna as claimed in claim 1, wherein the feed line comprises a coaxial cable having a core conductor and a sheath conductor, said core conductor being connected to the laminar conductor at a position adjacent the narrower end portion and said sheath conductor being connected to the ground plane.

11. An antenna as claimed in claim 7, wherein the feed line comprises a microstrip line formed by a strip conductor extending parallel to the ground plane and separated therefrom by a dielectric, the strip conductor being connected to said one of the opposite edges at a position adjacent the narrower end portion thereof.

* * * * *